US007182601B2

(12) United States Patent
Donnan

(10) Patent No.: US 7,182,601 B2
(45) Date of Patent: Feb. 27, 2007

(54) INTERACTIVE TOY AND METHODS FOR EXPLORING EMOTIONAL EXPERIENCE

(76) Inventor: Amy J. Donnan, 2820 W. 3rd Ave., Hibbing, MN (US) 55746

( * ) Notice: Subject to any disclaimer, the term of this patent is extended or adjusted under 35 U.S.C. 154(b) by 0 days.

(21) Appl. No.: 09/854,648

(22) Filed: May 14, 2001

(65) Prior Publication Data

US 2002/0061704 A1 May 23, 2002

Related U.S. Application Data

(60) Provisional application No. 60/203,620, filed on May 12, 2000.

(51) Int. Cl.
*G09B 19/00* (2006.01)
*A63H 3/02* (2006.01)

(52) U.S. Cl. ..... 434/236; 434/238; 446/297; 446/369

(58) Field of Classification Search ..... 434/236–238; 446/227, 297, 269
See application file for complete search history.

(56) References Cited

U.S. PATENT DOCUMENTS 2,729,020 A * 1/1956 Frampton ..... 273/153 R
4,341,521 A * 7/1982 Solomon ..... 434/236
4,378,215 A * 3/1983 Sparks ..... 434/113
4,636,172 A * 1/1987 Fredericks ..... 434/159
4,762,494 A * 8/1988 Woods ..... 434/236
4,917,607 A * 4/1990 Van Hoose ..... 434/236
5,013,246 A * 5/1991 Doyle ..... 434/236
5,092,778 A * 3/1992 Shaver et al. ..... 434/236
5,741,137 A * 4/1998 Aduvala ..... 273/292
6,422,871 B2 * 7/2002 Shepherd ..... 434/236

OTHER PUBLICATIONS

Snow White and the Seven Dwarves Figurines, "What a Character", 1950-1960's.*
Free Spirit Publishing Catalog, Early Summer 2000—pp. 11.
Childcraft Education Corp. Catalog, 2001—p. 206.
Lakeshore Learning Store Catalog—p. 5.
Childswork/Childsplay Catalog, Fall 2000—pp. 5, 22, 33, 44, 46, 47, 58.
Childswork/Childsplay Catalog, Winter/Spring 2001—pp. 12, 21.
Courage to Change Catalog, Winter 2001—pp. 10, 19, 31.

* cited by examiner

*Primary Examiner*—Dmitry Suhol
(74) *Attorney, Agent, or Firm*—Kagan Binder, PLLC

(57) ABSTRACT

An educational, interactive toy that symbolically represents emotions through visual, kinesthetic, and linguistic means. The toy includes a plurality of playpieces. Each playpiece is generally symbolic of a particular emotion, e.g., love, happy, sad, mad, and scared, respectively. The toy also includes a container having a storage chamber into which the playpieces may be independently stored or withdrawn during the course of play. The toy helps an individual understand that the process of emotional experience occurs when individual emotions are named, verbalized, and expressed via a combination of one or more of action, language, facial expression, and/or voice tone. The toy invites children to name and express specific emotions.

16 Claims, 16 Drawing Sheets

INTERACTIVE TOY AND METHODS FOR EXPLORING EMOTIONAL EXPERIENCE

This application claims priority from U.S. Provisional Application No. 60/203,620, filed May 12, 2000, the entire content of which is incorporated herein by reference.

FIELD OF THE INVENTION

The present invention relates to the field of educational, interactive toys. More particularly, the present invention relates to an interactive, educational toy for exploring emotions.

BACKGROUND OF THE INVENTION

The naming of emotion is a crucial stage of emotional development. Experts in the field of psychology indicate that an ability to name emotions and manage emotional experiences prepares an individual for the development of empathic social skills as well as cause and effect thinking. For instance, a child who "feels like hitting" has one outlet of expression in mind. In contrast, a child who "feels mad" can choose more than one response to his or her emotional experience.

Developmental experts describe specific stages of emotional development and/or healing, moving from the experience of physical sensation into the experience of emotion and gradual discrimination of specific emotional experiences. Regions of the brain are stimulated during emotional experience, but identification is made when an individual recognizes body and feeling sensations. Because of this physical feeling experience, it is important that individuals identify specific emotions through a combination of visual, kinesthetic, and linguistic means.

The naming of emotion is important throughout all of life and all areas of life. The ability to name emotion is thus important in a variety of environments. Particularly with respect to children, some of these environments include early childhood learning centers, child assessment and screening centers, environments serving as a complement to parenting education and social skill building curricula, at Head Start centers, hospitals, elementary schools, foster care environments. Helping children to name emotion is helpful and important to parents, teachers, foster care providers, and adoption workers.

Current educational and retail market toys frequently address the identification of emotion through recognition of facial expression, but unfortunately do not adequately address translation of emotion naming into physically felt experience. There also is a lack of toys available to provide a symbolic, kinesthetic approach to learning or to address the naming of emotion as a developmental stage. A variety of toys dealing with emotional experience, however, are commercially available. Western Psychological Services, Creative Therapy Store, offers a variety of toys that concern emotional experience. The Spring 2000 catalog from Thinking Publications (a distributor of products intended to enhance communication skills) offers only one emotion poster and one written book about feelings. Free Spirit Publishing offers the book "Hands are not for Hitting" by psychologist Martine Agassis. Lakeshore Learning Materials offers some posters and a game called "Feelings and Faces" that shows pictures of children with facial expressions representing emotion.

Notwithstanding these commercial sources of toys that relate to the emotional experience, there is still a great need for tools that help integrate and represent emotional experience. There is also still a great need for tools that address the naming stage in the development of emotional experience and that provide a visual, kinesthetic, and linguistic interaction.

SUMMARY OF THE INVENTION

The present invention introduces an educational, interactive toy that symbolically represents emotions through visual, kinesthetic, and linguistic means. A child, or group of children, can be introduced to emotions through interactive play, which stimulates visual, kinesthetic, and linguistic learning. The toy helps an individual understand that the process of emotional experience occurs when individual emotions are named, verbalized, and expressed via a combination of one or more of action, language, facial expression, and/or voice tone. In preferred embodiments, this toy symbolically represents specific emotions and the process of feeling by representing how emotions move in and out of the heart, which is the experiential center of emotion. The toy invites children to name and express specific emotions.

In one aspect, the present invention relates to an interactive toy for exploring emotional experience, and for identifying an naming emotion. The toy includes a plurality of manipulatives, preferably in the form of playpieces. Each playpiece is generally symbolic of a particular emotion, e.g., love, happy, sad, mad, and scared, respectively. The toy also includes a container having a storage chamber into which the playpieces may be independently stored or withdrawn during the course of play.

In another aspect, the present invention relates to a method of exploring emotional experience. The method includes providing the interactive, educational toy comprising a plurality of playpieces and a container as described herein. A user interacts with the toy, preferably visually, kinesthetically, and linguistically. A user may interact with the toy alone, but more desirably does so with another user and/or an adult who coaches and directs learning.

BRIEF DESCRIPTION OF THE DRAWINGS

The above mentioned and other advantages of the present invention, and the manner of attaining them, will become more apparent and the invention itself will be better understood by reference to the following description of the embodiments of the invention taken in conjunction with the accompanying drawings, wherein.

DETAILED DESCRIPTION OF PRESENTLY PREFERRED EMBODIMENTS

Figure 1:
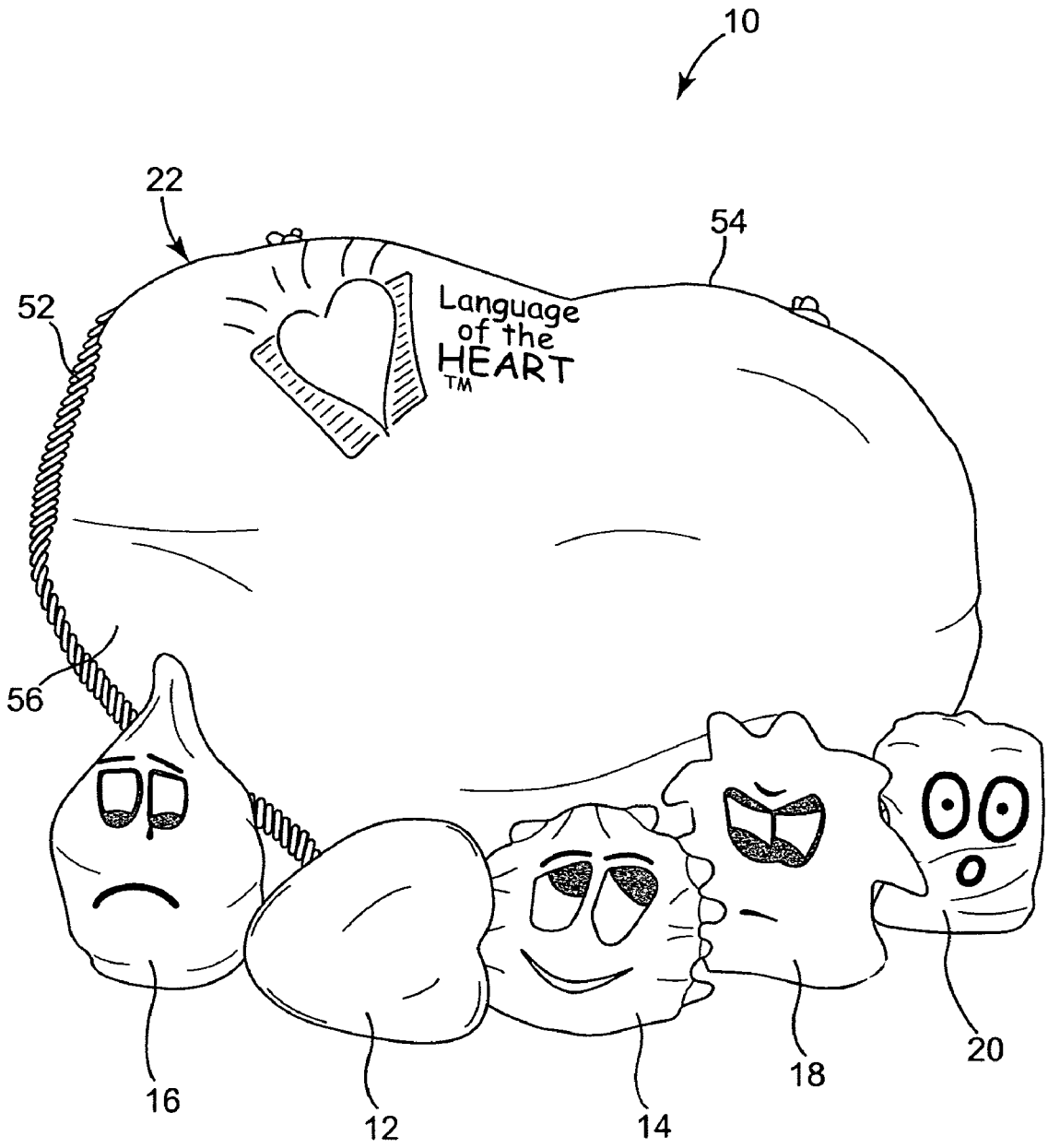
FIG. 1 is a perspective view of a preferred toy embodiment of the present invention in which the container is a heart-shaped, pillow bag and five playpieces generally symbolic of the emotions love, happy, sad, mad, and scared are uniquely shaped and decorated bean bags.
Figure 2:
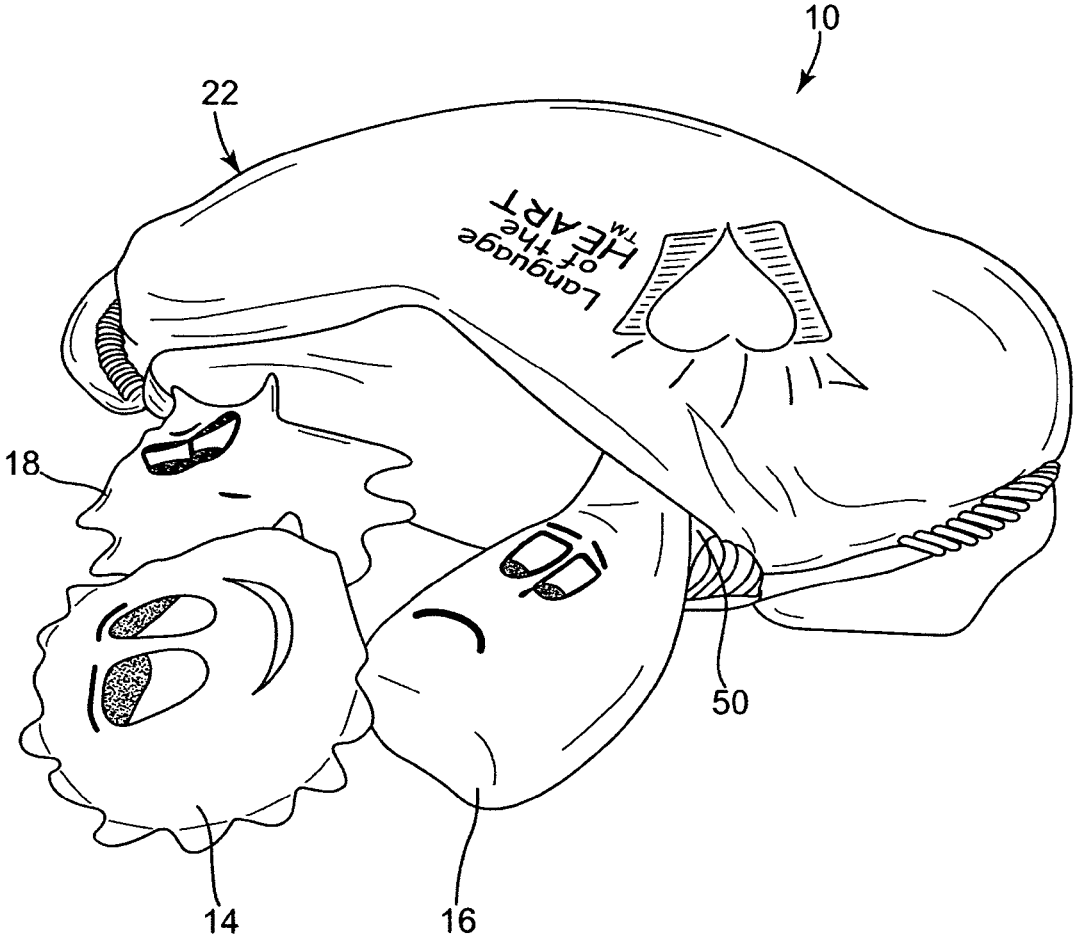
FIG. 2 is a perspective view of the toy of FIG. 1 showing the pouch of the container into which playpieces may be stored or from which playpieces may be withdrawn.
Figure 3:
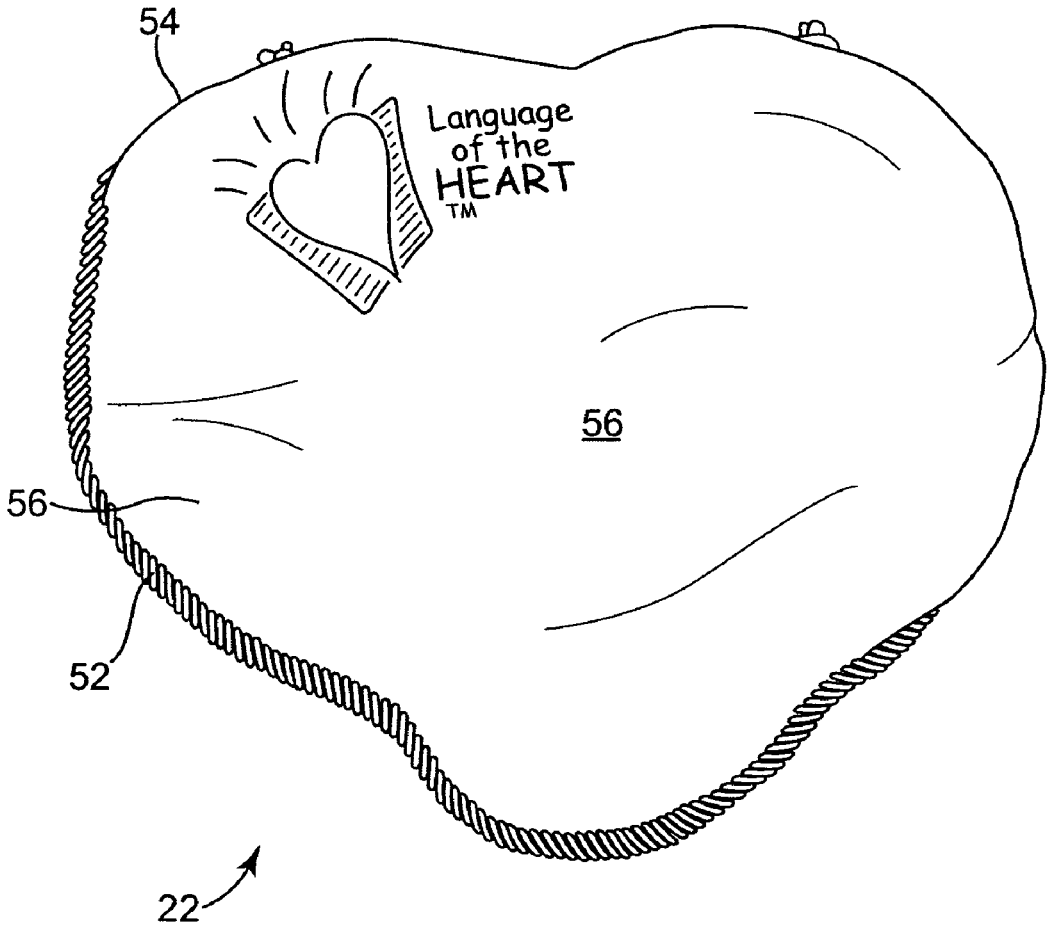
FIG. 3 is a front view of the heart-shaped pillow bag shown in FIG. 1.

The embodiments of the present invention described below are not intended to be exhaustive or to limit the invention to the precise forms disclosed in the following detailed description. Rather the embodiments are chosen and described so that others skilled in the art may appreciate and understand the principles and practices of the present invention.

A preferred embodiment of an educational toy 10 of the present invention is shown in FIGS. 1 through 8*b* and 10–12. Toy 10 generally includes a plurality of manipulatives in the form of playpieces 12, 14, 16, 18, and 20 as well as container 22. Each playpiece 12, 14, 16, 18, and 20 is generally symbolic of a particular emotion. For example, playpiece 12 is generally symbolic of love, playpiece 14 is generally symbolic of happy, playpiece 16 is generally symbolic of sad, playpiece 18 is generally symbolic of mad, and playpiece 20 is generally symbolic of scared.

Of course, these five playpieces and their respective emotions are merely representative of the different playpieces that may be used in the practice of the present invention to explore emotional experience. As desired, toy 10 may include any one or more of these five particular kinds of playpieces and/or one or more playpieces corresponding to other emotions. In addition to the five emotions represented in toy 10, more of these five particular kinds of playpieces and/or one or more playpieces generally symbolic of other emotions. In addition to the five emotions represented in toy 10, other representative emotions include annoyed, anxious, bashful, bored, cautious, confident, confused, curious, determined, disappointed, embarrassed, enthusiastic, exhausted, frustrated, hopeful, interested, jealous, lonely, proud, relieved, satisfied, surprised, suspicious, thoughtful, disgusted, and the like.

The playpieces 12, 14, 16, 18, and 20 may have any of a variety of forms. For example, playpieces 12, 14, 16, 18, and 20 of the present invention may be card-shaped, ball-shaped, block-shaped, stuffed-animal like, bean bag-like, in the form of a hand puppet, in the form of a finger puppet, etc. In the preferred embodiment illustrated in FIGS. 1 through 8*b*, each of playpieces 12, 14, 16, 18, and 20 has a bean bag like structure that is especially appealing to young children. For each of playpiece 12, 14, 16, 18, and 20, the bean bag structure includes one or more fabric panels enclosing a suitable stuffing material such as beans, beads, cotton, or the like. Any one or more of playpieces 12, 14, 16, 18, and 20 may optionally incorporate an audio device that emits sounds, music, words, and/or the like either spontaneously and/or when triggered by a user.

Each playpiece 12, 14, 16, 18, and 20 generally comprises one or more unique indicia generally symbolic of the particular emotion, respectively. Such indicia include, for example, text information, texture, graphic information, color scheme, shape, or the like. Combinations of such indicia preferably are used to encourage visual, kinesthetic, and linguistic interaction with toy 10.

Figure 4:
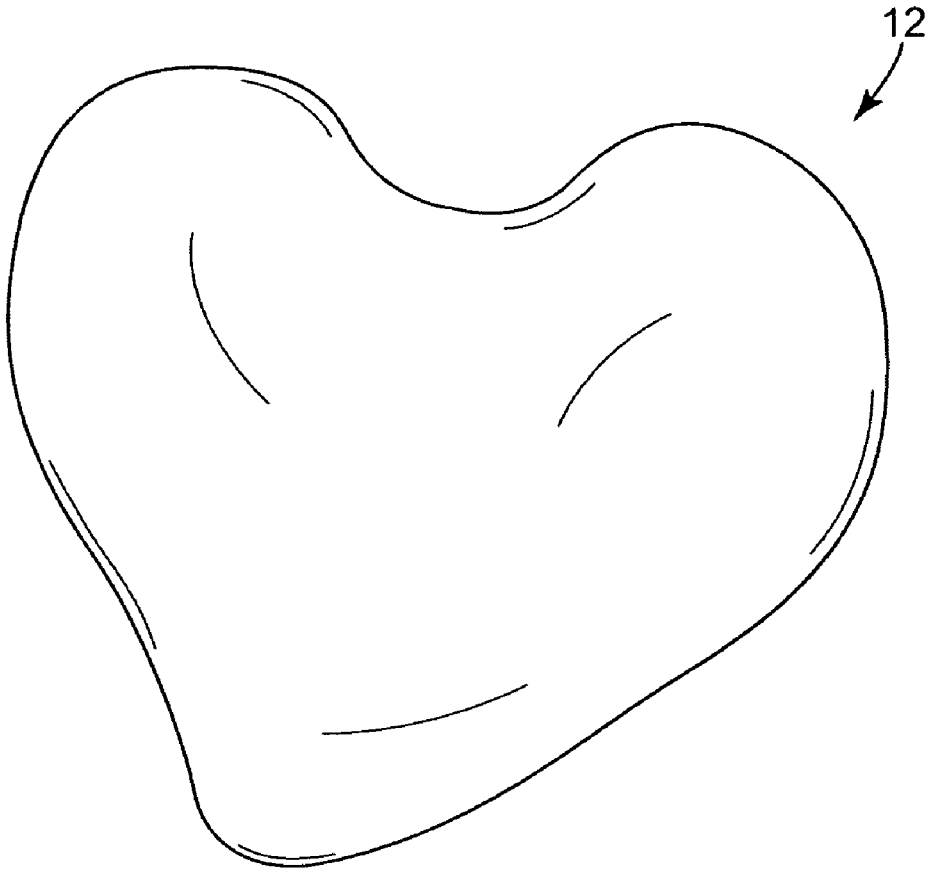
FIG. 4 shows the playpiece generally symbolic of love.

For example, as best seen in FIG. 4, playpiece 12 generally symbolizing love is heart-shaped and multicolored. The heart shape is symbolic of the love emotion. The multicolored, rainbow-like color scheme incorporates the colors used on the other playpieces 14, 16, 18, and 20 and symbolizes that love is a composite of all emotions. This playpiece is not limited to representations in this color scheme, but may also be gold, pink, red, purple, combinations thereof, other coloring schemes, or the like.

Figure 5A:
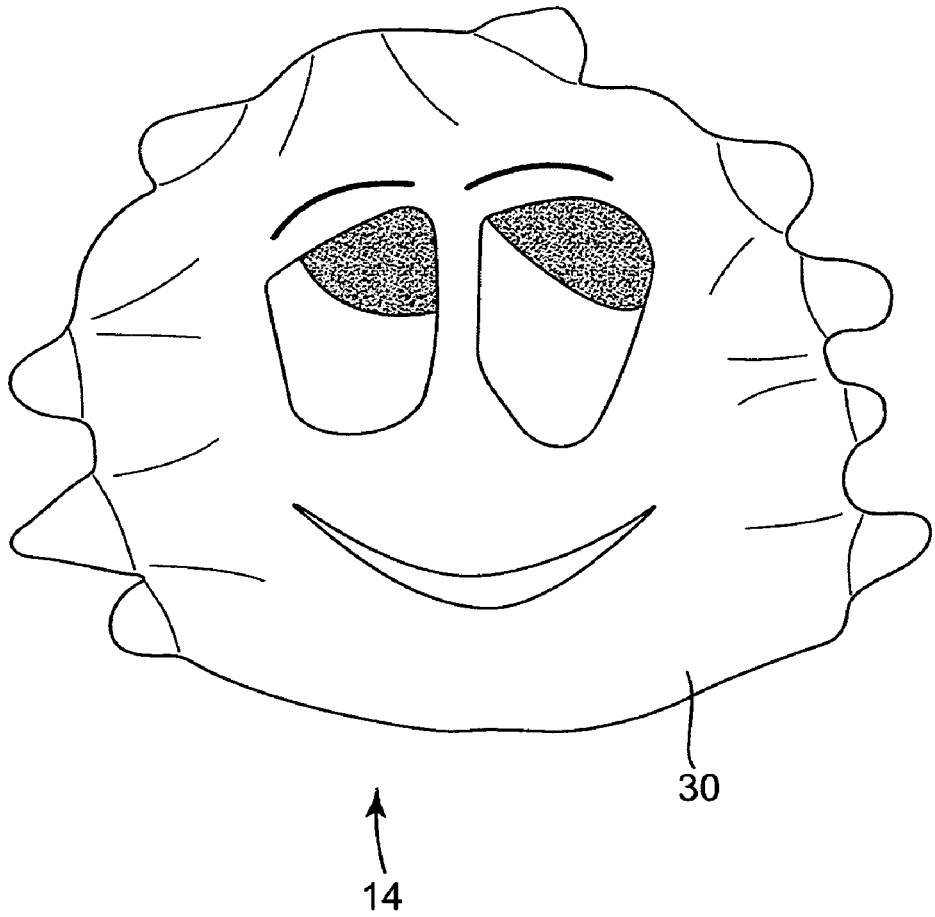
FIGS. 5*a* and 5*b* show the front and back views, respectively, of the playpiece generally symbolic of happy.
Figure 5B:
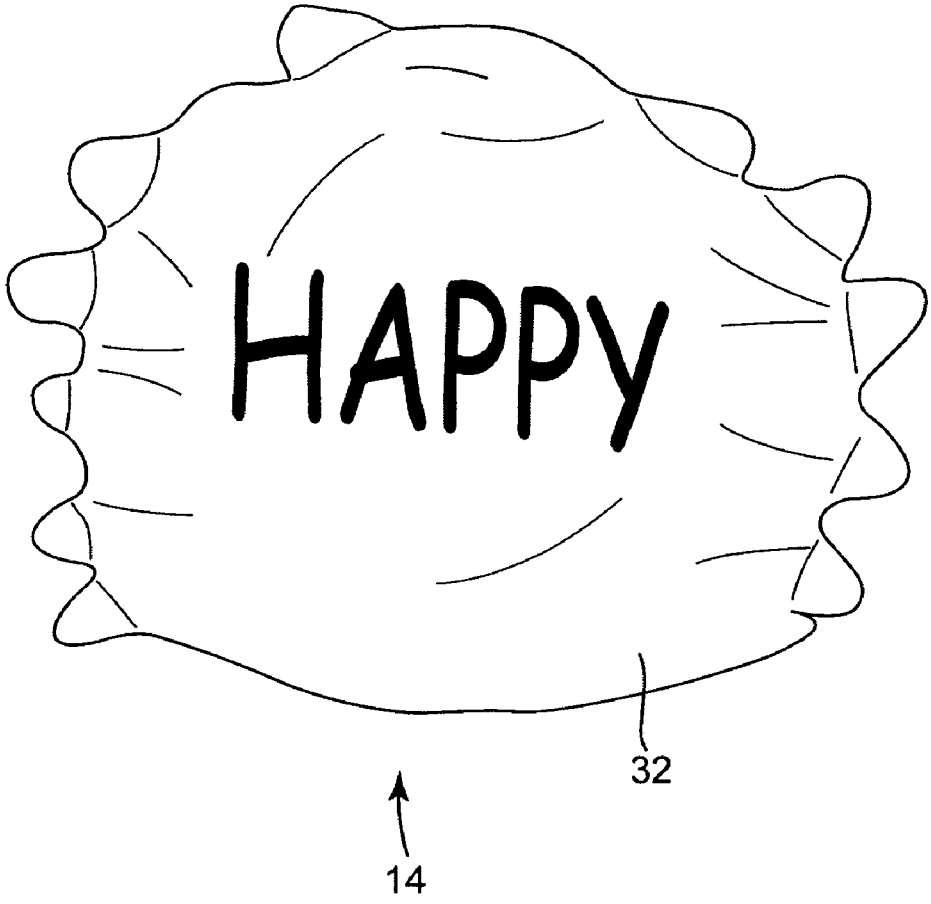

As shown best in FIGS. 5*a* and 5*b*, playpiece 14 generally symbolizing happy is a sun-shaped bean bag. Fabric panel 30 includes graphic information in the form of a happy expression. Fabric panel 32 on the other side of playpiece 14 includes, for purposes of illustration, the text information "happy". Panels 32 and 34 preferably are yellow, which symbolizes both happy and the sun.

Figure 6A:
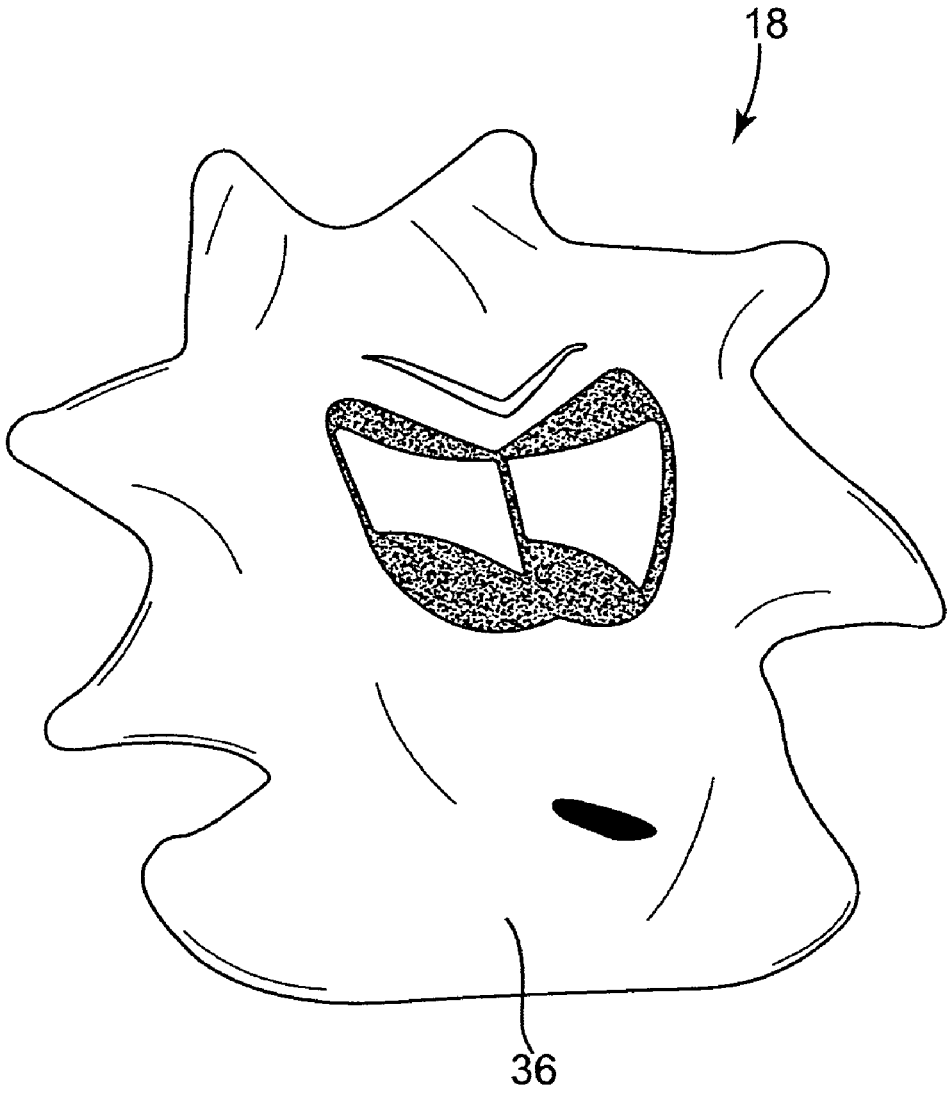
FIGS. 6*a* and 6*b* show front and back views, respectively, of the playpiece corresponding to mad.
Figure 6B:
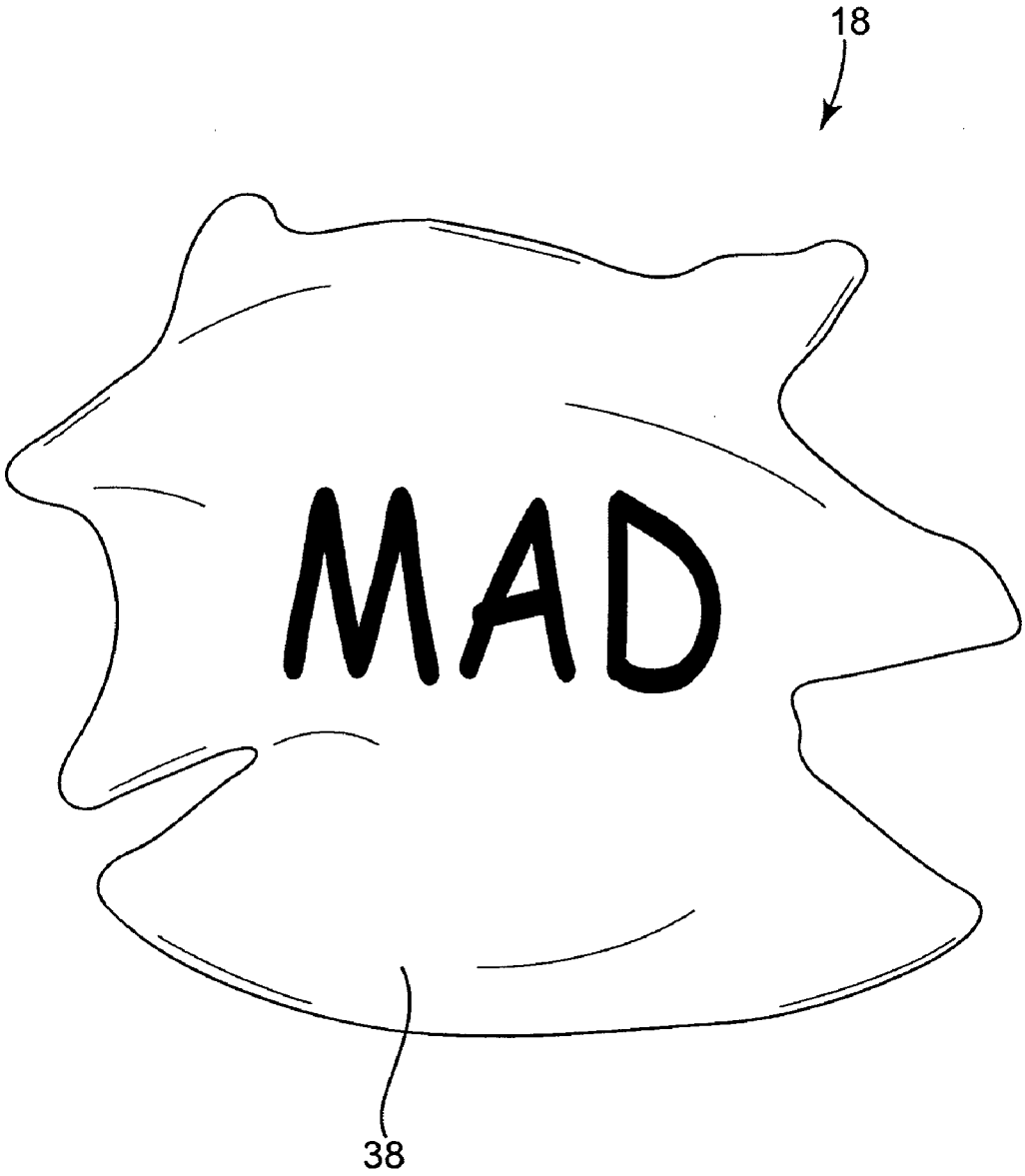

As shown best in FIGS. 6*a* and 6*b*, playpiece 18 generally symbolizing mad is a fire-shaped bean bag. Fabric panel 36 includes graphic information in the form of a mad expression. Fabric panel 38 on the other side of playpiece 18 includes, for purposes of illustration, the text information "mad". Fabric panels 36 and 38 preferably are red, which symbolizes both being mad and the color of fire.

Figure 7A:
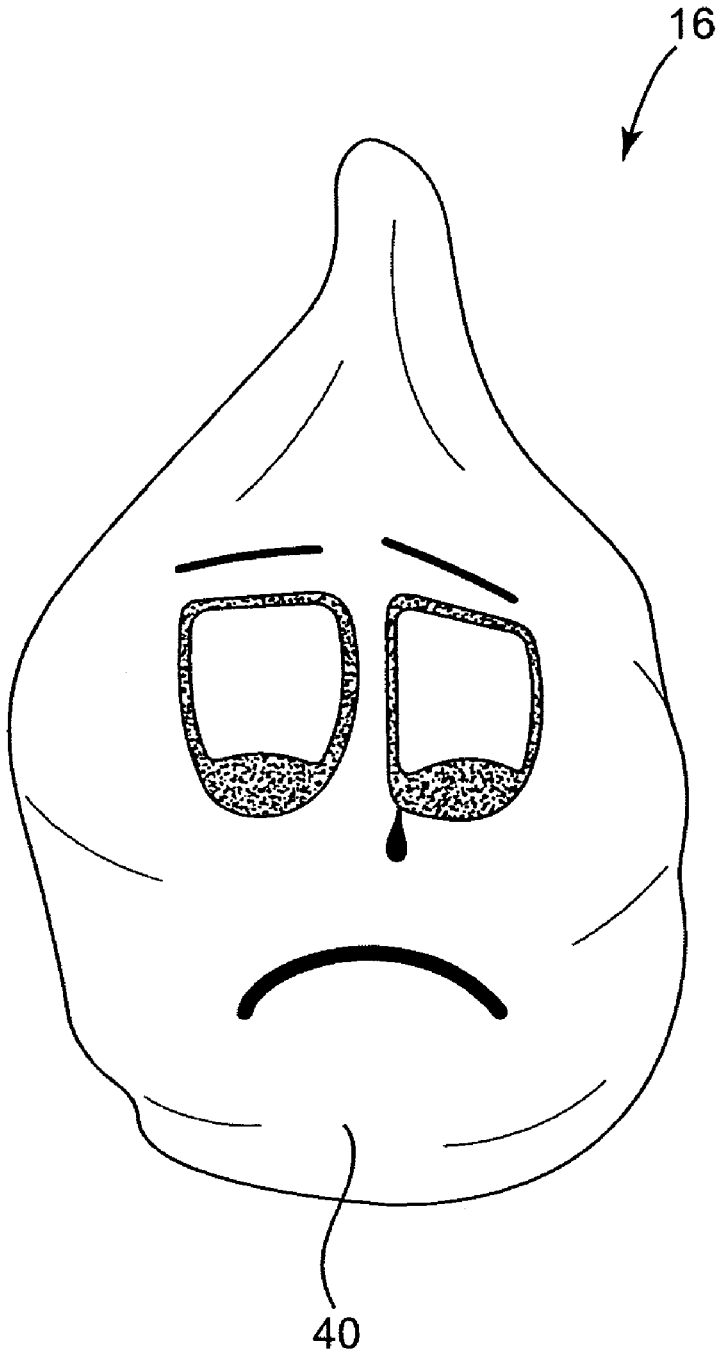
FIGS. 7*a* and 7*b* show the front and back views, respectively, of the playpiece generally symbolic of sad.
Figure 7B:
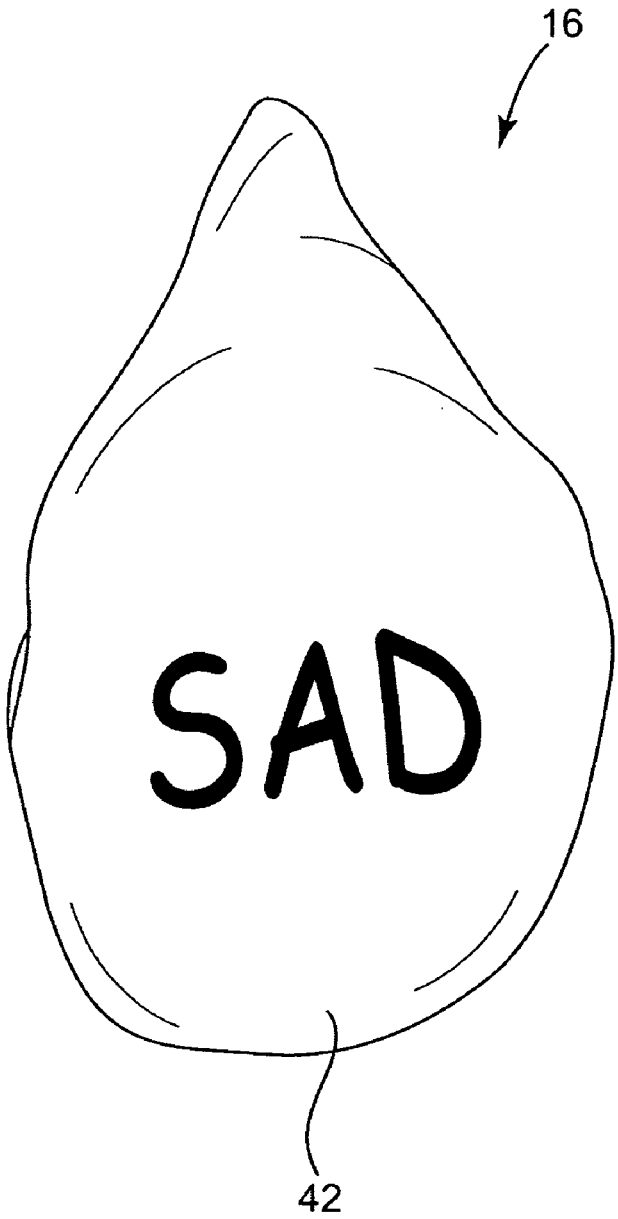

As shown best in FIGS. 7*a* and 7*b*, playpiece 16 generally symbolizing sad is a tear-shaped bean bag. Fabric panel 40 includes graphic information in the form of a sad expression. Fabric panel 42 on the other side of playpiece 16 includes, for the purposes of illustration, the text information "sad". Panels 40 and 42 preferably are blue, which symbolizes both being sad and the color of a tear drop.

Figure 8A:
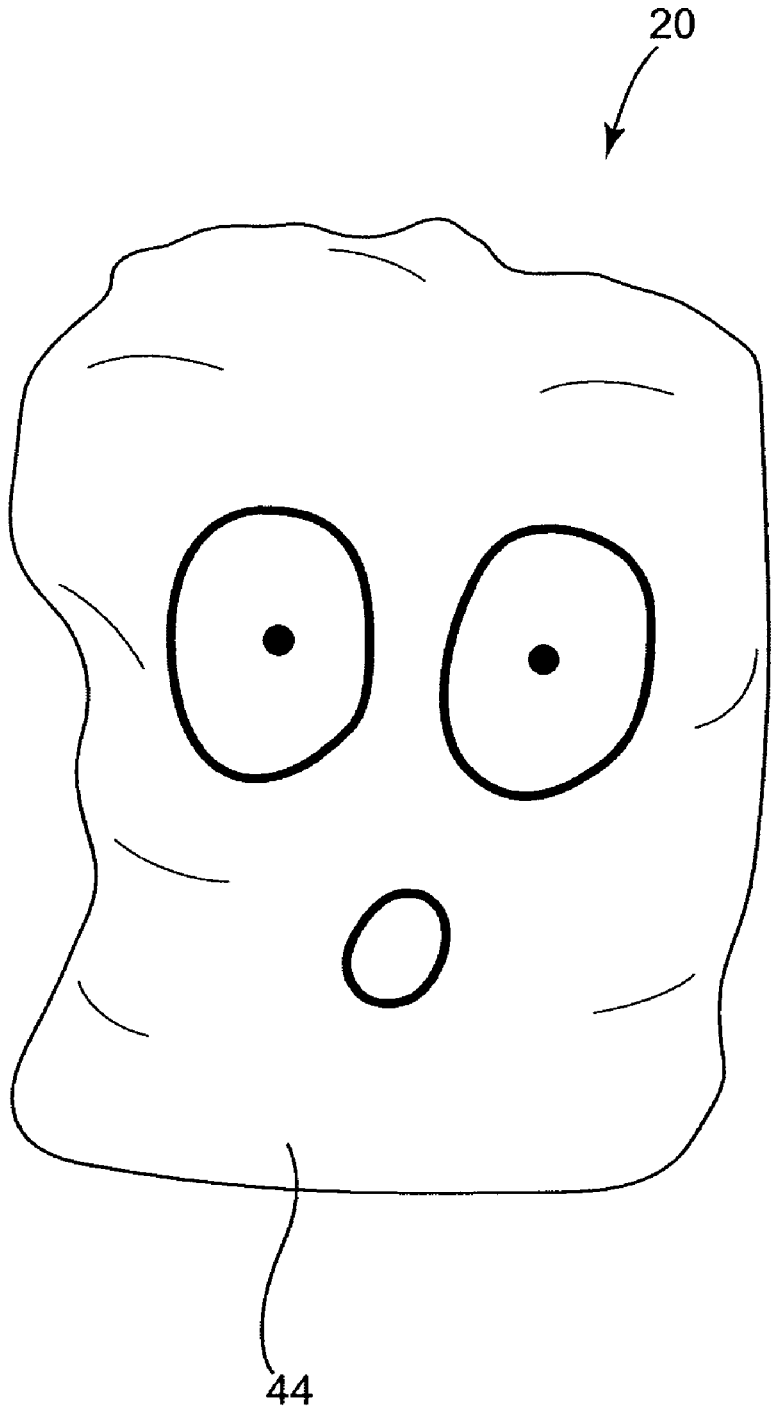
FIGS. 8*a* and 8*b* show the front and back views, respectively, of the playpiece generally symbolic of scared.
Figure 8B:
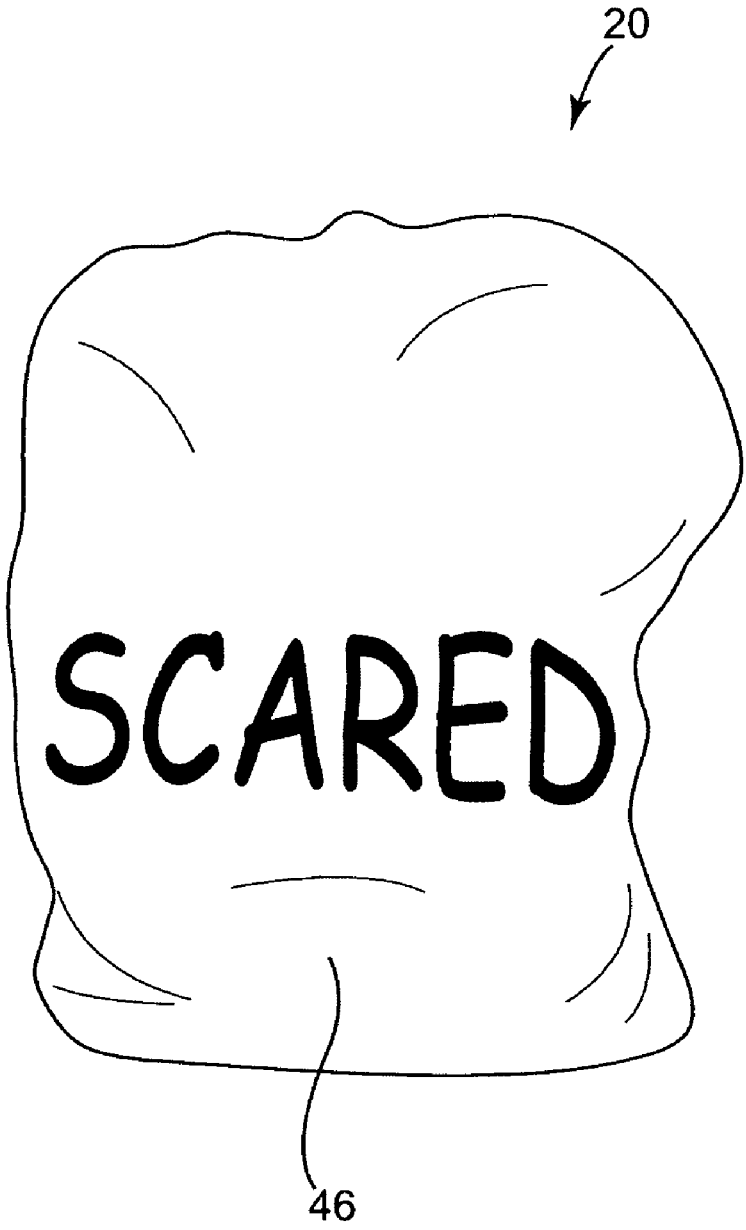

As shown best in FIGS. 8*a* and 8*b*, playpiece 20 is a ghost-shaped bean bag. Fabric panel 44 includes graphic information in the form of a scared expression. Fabric panel 46 on the other side of playpiece 20 includes, for purposes of illustration, the text information "scared". Fabric panels 44 and 46 preferably are green, although these may preferably be black, white, and/or gray if a green playpiece corresponding to jealously (not shown) were to be used.

Referring now primarily to FIGS. 1–3 and 10–12, container 22 includes chamber 50 in which playpieces 12, 14, 16, 18, and/or 20 may be independently stored or withdrawn. Container 22 may be provided in a wide variety of forms such as a bag, a pouch, a box, a backpack, or the like. Container 22 may be provided with an optional strap or handle (not shown) if desired. In the preferred embodiment shown, container 22 is a heart-shaped, stuffed panel, pillow bag. That is, the provision of stuffing within panels (not shown) of container 22, can result in container 22 having a plush, pillow like feel, and in fact, either with or without playpieces 12, 14, 16, 18 and/or 20 stored therein, container 22 provides a soft cushioned surface upon which a user may rest their head, using container 22 as a pillow, if desired. The preferred heart shape of container 22 facilities the learning experience that emotions come from the body. For example, when a user stores a playpiece into container 22, the user is symbolically placing an emotion.

Figure 9:
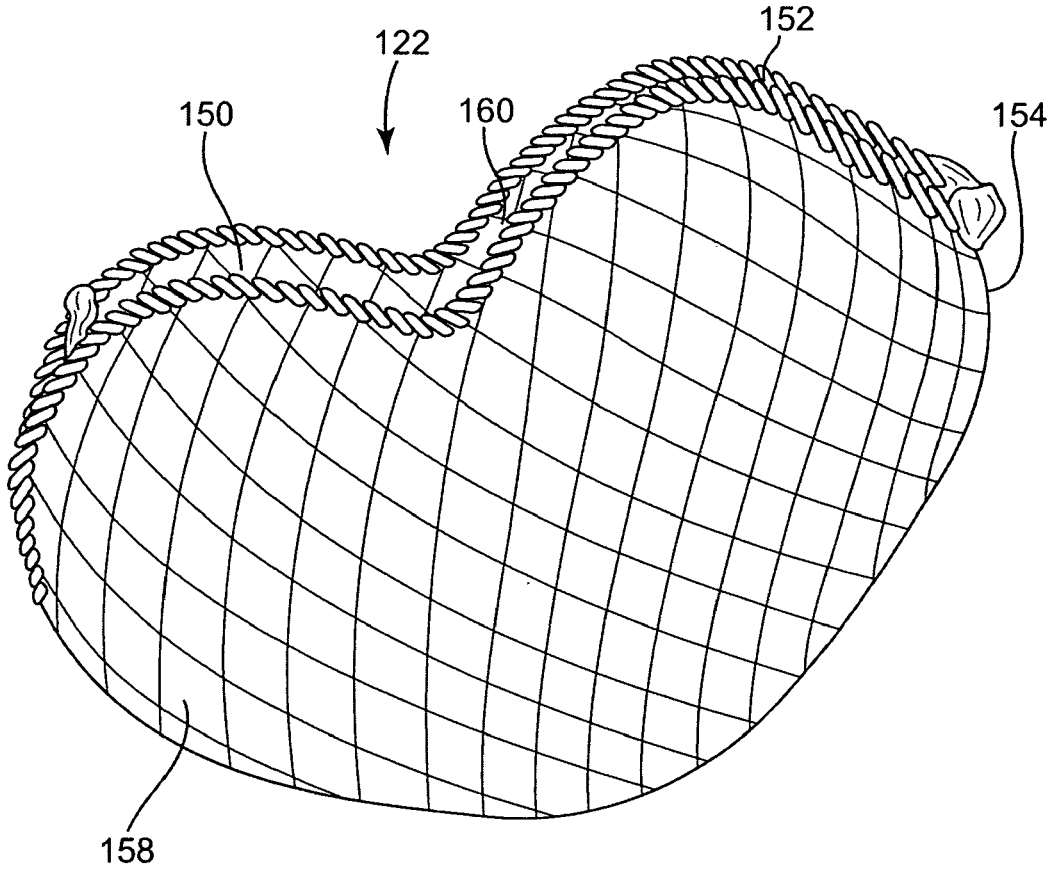
FIG. 9 shows a perspective view of an alternative embodiment of a heart-shaped, pillow bag of the present invention.

Container 22 may incorporate one or more functional or decorative features to make container 22 more appealing to a user. For example, container 22 as illustrated includes multicolored trim 52 around periphery 54. Trim 52 incorporates the colors used on playpieces 12, 14, 16, 18, and 20 to help visually connect the heart (i.e., container 22) to the various emotions (i.e., the playpieces). Graphic or textual information may also be provided on the exterior of container 22. For purposes of illustration, the logo and text "Language of the Heart" appear on fabric panel 56. The fabric used to form container 22 for purposes of illustration is a silky smooth, purple fabric, but container 22 could be any color(s) or texture(s). For example, FIG. 9 shows an alternative embodiment of a heart-shaped container 122 that includes chamber 150 and that has orange-colored, quilted fabric panels 158 and 160 and a multi-colored trim 152 around periphery 154.

Figure 10:
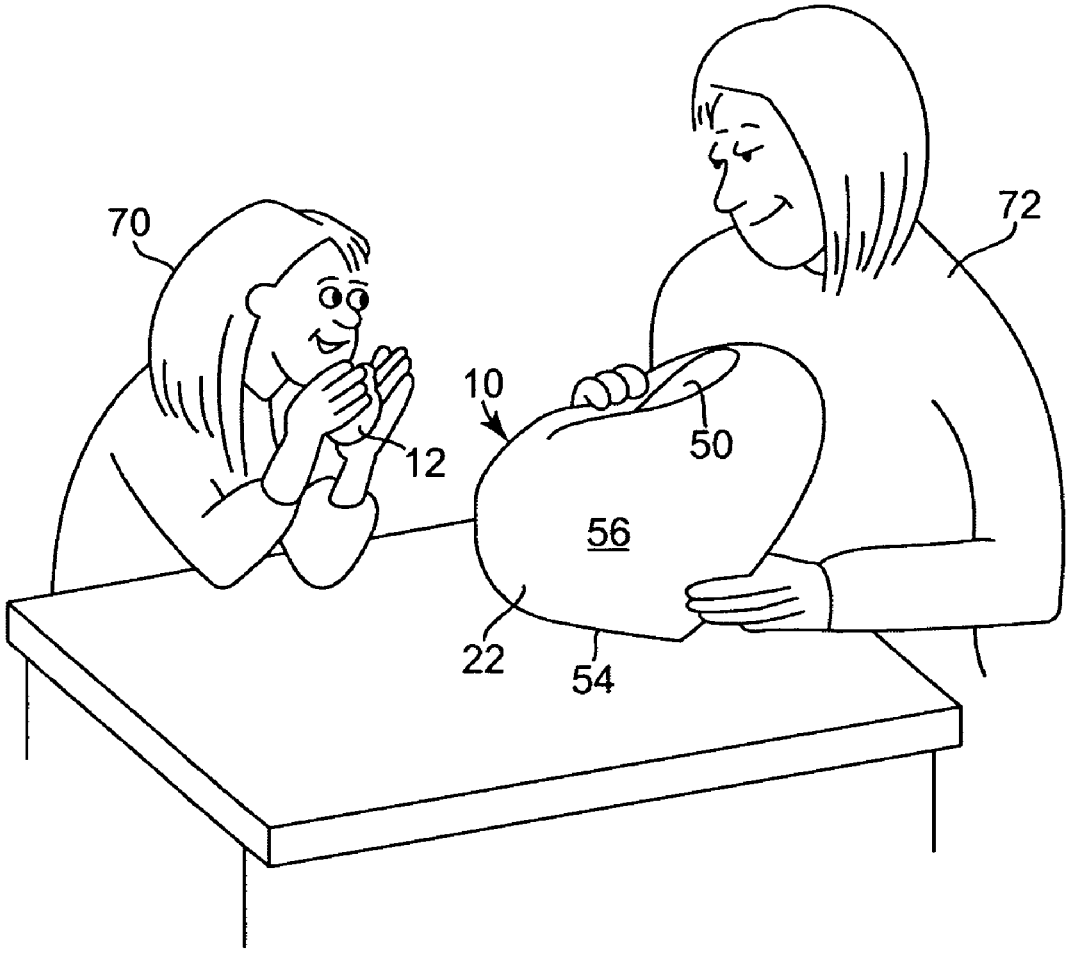
FIG. 10 shows a young child and another person interacting with the toy of FIG. 1.

FIG. 10 shows child 70 interacting with toy 10 with the help of another person 72, who may be another child, an older sibling, a parent, a teacher, a therapist, or the like. Child 70 is holding playpiece 14 and is engaged in a lively discussion about emotion with person 72. The ability of child 70 to symbolically hold an emotion and discuss thoughts about the emotion makes the emotional experience more concrete and provides a visual, kinesthetic, linguistic, and interactive process for learning. Advantageously, a concrete symbol for an otherwise fluid, sometimes overwhelming experience of emotion makes the experience more manageable and leads to a better understanding of cause and effect. For instance, a child can pick up a playpiece and describe situations that elicit the corresponding emotional experience. This correctly ties the experienced emotion to stimuli and allows a child or adult to plan for responsive actions.

Figure 11:
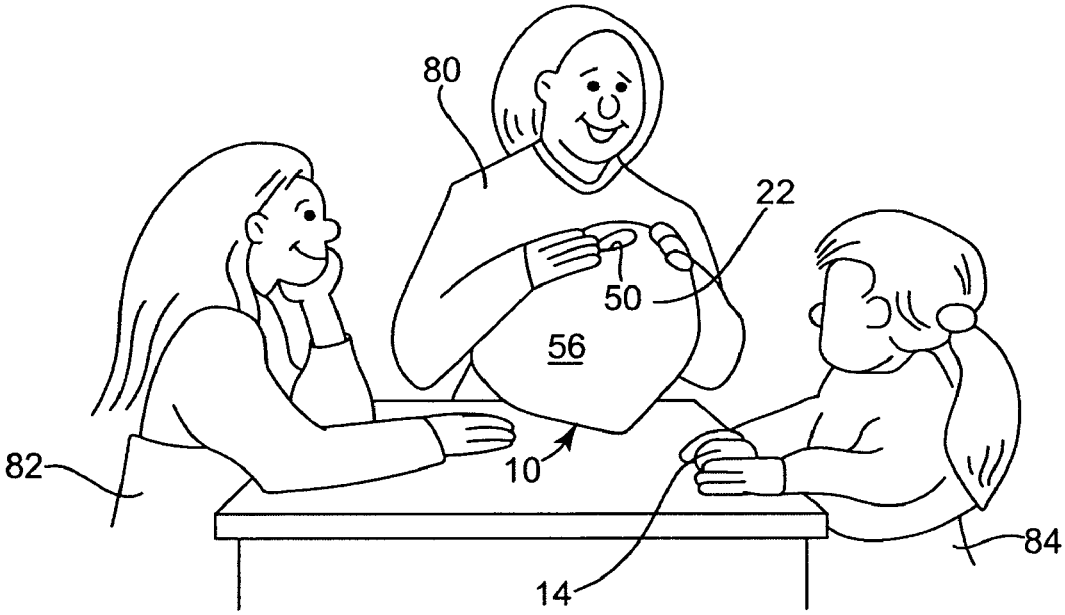
FIG. 11 shows two young children and another person interacting with the toy of FIG. 1.

FIG. 11 shows instructor 80, child 82 and child 84 interacting with toy 10. This shows that toy 10 can be used with groups of children to explore emotional experience.

Figure 12:
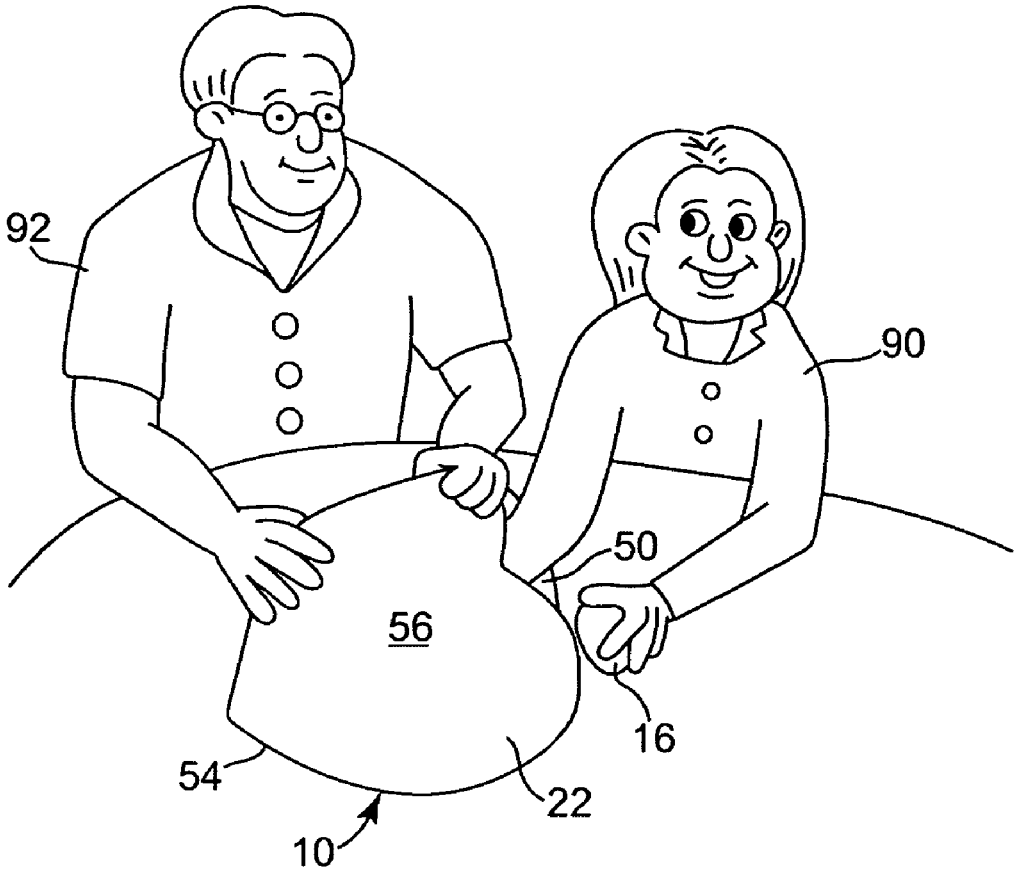
FIG. 12 shows a young child pulling a playpiece/emotion from the heart-shaped pillow bag of FIG. 1.

FIG. 12 shows child 90 and another person 92 interacting with toy 10. In this case, child 90 is in the act of pulling a playpiece from container 22, which symbolizes pulling an emotion from the heart. This act helps child 90 to learn that emotions come from the body.

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims.

The invention claimed is:

1. An interactive toy for exploring an emotional experience, comprising:

(a) a plurality of playpieces, each playpiece being generally symbolic of a particular emotion, and having a bean bag like structure and each playpiece comprising a unique color with respect to the other playpieces, a unique shape with respect to the other playpieces, an audio device that emits a sound and a unique visually discernible facial expression with respect to the other playpieces, said facial expression corresponding to the particular emotion and comprising eyes and a mouth; and (b) a container comprising a storage chamber into which the playpieces may be independently stored or withdrawn during the course of play wherein the container is a plush, heart-shaped, pillow bag.

2. The interactive toy of claim 1, wherein the playpieces comprise a first playpiece generally symbolic of love, a second playpiece generally symbolic of sadness, a third playpiece generally symbolic of happiness, a fourth playpiece generally symbolic of anger, and a fifth playpiece generally symbolic of fear.

3. The interactive toy of claim 2, wherein the playpiece generally symbolic of sadness is tear drop-shaped.

4. The interactive toy of claim 2, wherein the playpiece generally symbolic of happiness is sun-shaped.

5. The interactive toy of claim 2, wherein the playpiece generally symbolic of anger is fire-shaped.

6. The interactive toy of claim 2, wherein the playpiece generally symbolic of fear is ghost-shaped.

7. The interactive toy of claim 1, wherein one or more of the playpieces each respectively comprises one or more panels enclosing a stuffing material.

8. The interactive toy of claim 1, wherein the container is heart-shaped.

9. The interactive toy of claim 1, wherein the container is a plush, pillow bag.

10. The interactive toy of claim 1, wherein each playpiece further comprises textual information indicative of the particular emotion corresponding to the playpiece.

11. A method of exploring emotional experience, comprising the steps of:

(a) having a child describe a visual, kinesthetic, or linguistic expression experienced by the child in a particular situation;

(b) providing a toy comprising a plurality of playpieces, each playpiece being generally symbolic of a particular emotion and having a bean bag like structure and each playpiece comprising a unique color with respect to the other playpieces, a unique shape with respect to the other playpieces, an audio device that emits a sound and a unique visually discernible facial expression with respect to the other playpieces, said facial expression corresponding to the particular emotion and comprising eyes and a mouth, and a container comprising a storage chamber into which the playpieces may be independently stored or withdrawn during the course of play; wherein the container is a plush, heart-shaped, pillow bag (c) allowing the child to interact with the toy in a manner that causes the child to name an emotion in connection with the particular situation: and (d) teaching the child to correlate the named emotion to the visual, kinesthetic, or linguistic expression experienced by the child in the particular situation.

12. The method of claim 11, wherein interacting with the toy comprises visually, kinesthetically, and linguistically exploring an emotional experience.

13. The method of claim 11, wherein step (b) comprises withdrawing a playpiece from the container.

14. The method of claim 11, further comprising naming the emotion corresponding to the playpiece.

15. The method of claim 11, wherein each playpiece further comprises textual information indicative of the particular emotion corresponding to the playpiece.

16. An interactive toy for exploring an emotional experience, comprising:

(a) a plurality of playpieces, each playpiece being generally symbolic of a particular emotion, and having a bean bag like structure and each playpiece comprising a unique color with respect to the other playpieces, a unique shape with respect to the other playpieces, an audio device that emits a sound and a unique visually discernible facial expression with respect to the other playpieces, said facial expression corresponding to the particular emotion and comprising eyes and a mouth, wherein said unique shape is symbolic of the emotion indicated by the facial expression; and (b) a container comprising a storage chamber into which the playpieces may be independently stored or withdrawn during the course of play wherein the container is a plush, heart-shaped, pillow bag.

* * * * *

UNITED STATES PATENT AND TRADEMARK OFFICE

CERTIFICATE OF CORRECTION

PATENT NO. : 7,182,601 B2
APPLICATION NO. : 09/854648
DATED : February 27, 2007
INVENTOR(S) : Donnan It is certified that error appears in the above-identified patent and that said Letters Patent is hereby corrected as shown below:

Column 5
Line 37 Claim 1, “emotion, and” should be --emotion and--.
Line 38 Claim 1, “structure and” should be --structure, and--.
Line 41 Claim 1, “sound and” should be --sound, and--.
Line 48 Claim 1, “play wherein” should be --play, wherein--.

Column 6
Line 17 Claim 11, “structure and” should be --structure, and--.
Line 20 Claim 11, “sound” should be --sound,--.
Line 26 Claim 11, “play;” should be --play,--.
Line 28 Claim 11, “bag” should be --bag;--.
Line 32 Claim 11, “situation:” should be --situation;--.
Line 51 Claim 16, “emotion, and” should be --emotion and--.
Line 52 Claim 16, “structure and” should be --structure, and--.
Line 55 Claim 16, “sound and” should be --sound, and--.
Line 63 Claim 16, “play wherein” should be --play, wherein--.

Signed and Sealed this

Fifth Day of June, 2007

JON W. DUDAS
*Director of the United States Patent and Trademark Office*